US005189863A

United States Patent [19]

Pozzi

[11] Patent Number: 5,189,863

[45] Date of Patent: Mar. 2, 1993

[54] VIDEO IMAGING TECHNIQUE USED IN BAGGING ASSEMBLY

[75] Inventor: John R. Pozzi, Allentown, Pa.

[73] Assignee: Brown Printing Company, A Division of Gruner & Jahr Printing and Publishing Co., Waseca, Minn.

[21] Appl. No.: 855,514

[22] Filed: Mar. 20, 1992

[51] Int. Cl.[5] ..... B65B 61/02; B65B 61/26; G06K 9/00

[52] U.S. Cl. ..... 53/411; 53/131.4; 53/461; 53/493; 209/584

[58] Field of Search ..... 53/411, 493, 58, 55, 53/77, 52, 131.4, 131.5, 131.2, 206, 569, 461, 284.3; 382/1; 209/584, 583

[56] References Cited

U.S. PATENT DOCUMENTS

| | | | |
|---|---|---|---|
| 3,227,886 | 1/1966 | Dunigan | 250/223 |
| 3,444,517 | 5/1969 | Rabinow | 340/146.3 |
| 3,587,856 | 6/1971 | Lemelson | 209/111.7 |
| 3,888,365 | 6/1975 | Reimann et al. | 340/172.5 X |
| 4,739,606 | 4/1988 | Cantile | 53/569 X |
| 4,776,464 | 10/1988 | Miller et al. | 209/3.3 |
| 4,790,119 | 12/1988 | McDaniels | 53/411 |
| 4,872,024 | 10/1989 | Nagai et al. | 346/1.1 |
| 4,908,768 | 3/1990 | Gelfer et al. | 364/464 |
| 4,943,369 | 7/1990 | Gombault | 209/583 |
| 4,953,841 | 9/1990 | Polarek | 270/58 |
| 5,025,610 | 6/1991 | Graushar | 53/411 |
| 5,034,985 | 7/1991 | Keough | 382/1 |
| 5,042,667 | 8/1991 | Keough | 209/584 X |
| 5,054,984 | 10/1991 | Chan et al. | 412/1 |
| 5,117,610 | 6/1992 | Hartman et al. | 53/411 |
| 5,137,304 | 8/1992 | Silverschotz et al. | 53/411 X |

*Primary Examiner*—James F. Coan
*Attorney, Agent, or Firm*—Haugen and Nikolai

[57] ABSTRACT

A video imaging technique used in a bagging assembly for magazines, books or the like. The bagging assembly selectively adds onserts and tip-ons to the magazines prior to being bagged in a polybag. The invention includes a method of selectively adding onserts which are contained in a plurality of storage bins by implementing a vision system using a video camera. The vision system defines a plurality of video windows which are used for identifying a dot code pattern which is printed on a mailing label by an ink-jet printer. The dot code pattern identifies which ones of a plurality of storage bins are to be actuated to subsequently dispense an onsert onto the magazine as it passes thereunder. By using a vision system, the dot code pattern can be offset vertically or horizontally, or skewed up to 15 degrees. The vision system creates a pair of video windows used for first sensing reference marks, and three windows for subsequently sensing characters positioned therebetween. The characters are arranged in a binary format corresponding to which ones the onserts are to be added. The identified dot code pattern is compared to a table stored in memory to ascertain which storage bins are to be actuated to effect release of an onsert in timed relation to the travel of the magazine stream along a conveyor. Other post production processes can be performed as well using mail sortation marks to perform mail sortation, applying personalized messages to the covers of magazines, and determining if magazines are to be manually or automatically bundled.

15 Claims, 5 Drawing Sheets

*Fig.-3A*

```
                    92
LINE NO. Ø1> Ø ▮ • • Ø<
         Ø2> ***************** CAR-RT ** CRO7 <
         Ø3> SUBSRIPTION INFORMATION          A <
         Ø4> NAME, TITLE                        <
         Ø5> COMPANY NAME                       <
         Ø6> NUMBER, ADDRESS                    <
         Ø7> CITY, STATE, ZIP                   <
         Ø8>                                    <
         1Ø>      <
```

94

90

*Fig.-3B*

DESCRIPTION OF BOX MARK CODES

A = Ø ▮ • • Ø = POCKET 1 ENABLED

B = Ø • ▮ • Ø = POCKET 2 ENABLED

C = Ø ▮ ▮ • Ø = POCKETS 1 AND 2 ENABLED

D = Ø • • ▮ Ø = POCKET 3 ENABLED

E = Ø • ▮ ▮ Ø = POCKETS 2 AND 3 ENABLED

F = Ø ▮ • ▮ Ø = POCKETS 1 AND 3 ENABLED

G = Ø ▮ ▮ ▮ Ø = POCKETS 1, 2 AND 3 ENABLED

SPACE = Ø • • • Ø = NO POCKETS ENABLED

*Fig.-4*

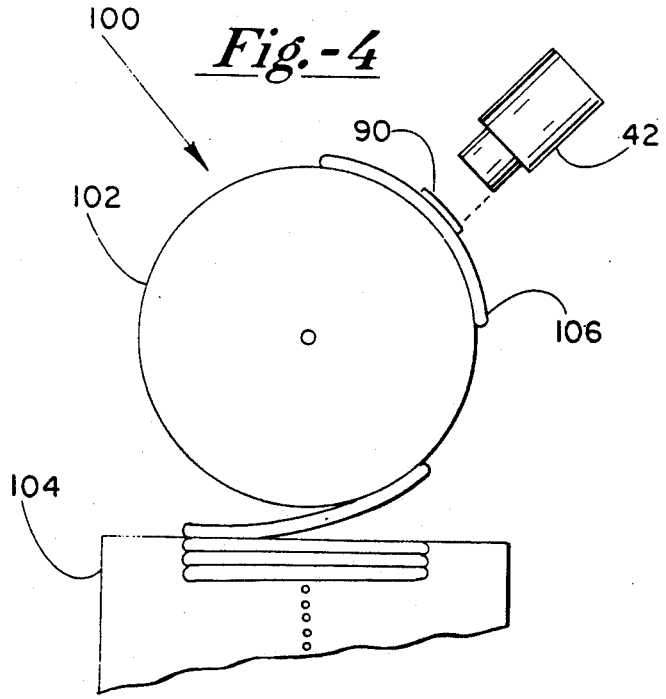

VIDEO IMAGING TECHNIQUE USED IN BAGGING ASSEMBLY

BACKGROUND OF THE INVENTION

I. Field of the Invention

The present invention relates generally to apparatus for the selective addition of onserts onto finished magazines and post production off-line processing with fully automated postal sortation stock generation for ultimate mailing. More particularly, the invention includes a method for selectively adding the onserts to magazines or the like using a programmable vision system for sensing and decoding a dot code pattern defined as a portion of a mailing label.

II. Description of the Prior Art

Printing companies involved in the production of magazines, catalogs, and the like, often assemble the finished magazines with onserts and "tip-ons" which are then together placed in a polybag for mailing to the recipient. These onserts, such as advertisements comprised of loose sheets or booklets, are typically stored in separate bins which are sequentially positioned along an assembly line above a conveyor belt. When a bin is selected, it dispenses one of the contained onserts onto the magazine as it passes thereunder. Typically, up to 3 bins may be used for containing onserts. While these onserts are individually rather inexpensive, in a high volume setting, it is economically desirable to only add certain onserts to magazines which are to be sent to selected recipients on who demographic information may be known. Marketing departments or advertisers typically decide which onserts are to be added to the magazines based on demographic studies. For example, subscribers having a certain zip code representing a wealthier neighborhood may receive selected onserts with their magazines that only these types of households would be interested in. Some advertisers choose to provide advertisements wit magazines to solicit certain age brackets, or households with certain educational backgrounds. The selective addition of onserts to the magazines is also important so that the subscriber will not be overwhelmed with to many onserts. Finally, it is economically desirable to selectively provide the onserts to selected subscribers to avoid waste and to reduce mailing charges.

Applying bar codes on mailing labels of magazines is one method known in the art for automatically selecting which onserts are to be added to a particular magazine prior to bagging. A bar code reader will sense a unique bar code defined on the mailing label of each magazine which is representative of the intended recipient. Bar code readers, however, are very "unforgiving" when sensing a bar code that is not uniformly oriented under the reader. As such, they tend to have degraded performance if the label bearing the bar code is skewed or rotated from a preselected orientation during scanning. The machines that apply mailing labels after they are produced by, for example, ink jet printers, are not known to uniformly position the mailing labels upon the magazines. For instance, labels rotated up to 15 degrees, or offset ⅛ of an inch laterally, are common. Therefore, bar code readers can have a degraded performance if the placement and orientation of the mailing labels with bar codes is not rigidly uniform.

Optical code readers are also well known in the art, but tend to have a degraded performance for most of the same reasons as bar code readers. They are not very forgiving to a misaligned or misoriented code relative to a reading station and as such, their performance can be degraded if a code is oriented or skewed from an ideal alignment. Thus, these different systems are not ideal for sensing information on mailing labels in this particular application.

U.S. Pat. No. 5,025,610 to Graushar teaches an apparatus and method for selectively packaging magazines. The system utilizes a controller which accesses a data record, such as a magnetic tape, throughout the entire assembly process to determine which signatures are to be incorporated to form a particular book. This data record is also accessed if onserts are to be added to the magazine. The drawback of this invention lies in that the computer is tied-up throughout the entire assembly process of the magazine. The processing of re-orders to replace damaged or unacceptable magazines is difficult, and processing magazines off-line, such as magazines manufactured elsewhere, cannot be accommodated.

U.S. Pat. No. 4,953,841 issued to Polarek teaches a machine and process for separating book pages by sensing signatures. This system teaches a decollator for disassembling incomplete books and sorting identical signatures into groups for re-use. The invention of that patent uses a video camera rather than a bar code reader or a line scanner. In the "separation mode", pages having a corresponding indicia, such as ellipse or a triangle, are separated into groupings.

U.S. Pat. No. 4,908,768 teaches an inserter based mail manifesting system. The system uses well-known optical character readers to detect code information. Thereafter, provision is made for preparing a manifest which is to accompany that batch of mail.

U.S. Pat. No. 5,034,985 to Keough teaches a matched mailing system employing address print array recognition. This invention comprises a machine for matching an address on an envelope to an address on a document, and when a match results, the document is stuffed in an envelope for mailing. This system implements an optical character reader where, the entire address is scanned to obtain a print array representative of the address. The address label needs to maintain precise alignment such that the optical reader can sufficiently and accurately decode the address label.

The processing of finished magazines is a unique process having its own design constraints, thus making prior art solutions only moderately suitable to such a process. Thus, developing a system which is uniquely adapted to the environment of selectively adding onserts onto magazines by sensing address labels is desirable.

OBJECTS

It is a primary object of the present invention to provide a method for selectively adding onserts contained in a plurality of storage bins to a continuous stream of magazines which is adapted to tolerate skewing of codes on address labels.

It is a further object of the present invention to provide a method for selectively adding onserts which can compensate for both rotational skewing and lateral offsets of the code on an address label.

It is a further object of the present invention to provide a unique code upon an address label which can be reliably sensed by a sensor for decoding.

It is a further object of the present invention to provide a method of selectively adding onserts which is capable of identifying a code extremely quickly and reliably.

It is a further object of the present invention to provide a method of determining which of a set of post-production processes are to be performed on a magazine including: mail sortation, applying personalized messages to the cover of a magazine, determining if a magazine is to be manually or automatically bundled, and determining when a magazine is to be on top of a stack such that the stack can be bundled.

Other an further objects of the present invention will become apparent to those skilled in the art upon a study of the following specification, pending claims and accompany drawings.

SUMMARY OF THE INVENTION

The foregoing features and objects of the invention are achieved by utilizing a commercially available vision system, including a plurality of windows, for identifying a dot code pattern present on the mailing label of a magazine and using the decoded information to control a post-production process including the selective addition of onserts contained in a plurality of storage bins to a continuous stream of magazines, or the like. The method involved comprises the steps of first generating a address label, including a dot code pattern, and applying the address label to the magazines. The dot code pattern corresponds to which ones of the onserts are to be added to that particular magazine. Next, the magazine is transferred to an identification station. At the identification station, the dot code pattern of the label of the magazine is sensed using a computing means including a video camera. The computing means generates the plurality of video windows which, in combination, are used for identifying the dot code pattern to determine which ones of the onserts are to be added to the magazine. Next, the magazine is transferred past each of the plurality of storage bins, wherein the bins containing the identified ones of the onserts corresponding to the dot code pattern are sequentially responsive to the computing means to dispense one of the contained onserts onto that magazine as it passes by. Then, the magazine including the deposited onserts move into a polybag at a polybagging station for ultimately being mailed. This method is repeated for each magazine which is to ultimately be mailed to a recipient, such as a subscriber or a customer.

The computing means and the video camera are preferably comprised of a CVIM Vision System manufactured by the Allen-Bradley Company of Milwaukee, Wis. This vision system includes software allowing several reference and character windows to be custom defined to specified dimensions and orientation upon the video image. As portions of the dot code pattern including reference marks and characters come into view in these windows, the images viewed through a pair of reference windows are compared against a mask to determine if a dot code pattern is in view. Then, a set of character windows individually sense the characters viewed through each on a pixel by pixel basis. Then, if all the windows, as a whole, sense images corresponding to a pattern in a table stored in memory, the dot code pattern is identified. The CVIM System will then sequentially enable the corresponding bins represented by the dot code pattern as the magazine passes thereunder.

The dot code pattern preferably comprises three characters comprised of either a "." or a darkened box, each linearly arranged between a reference mark "Ø" defined at each end thereof. When the reference marks "Ø" are identified in each of the respective reference windows, the three characters defined therebetween will next be identified. These three characters are essentially binary symbols which are identified as markings corresponding to either binary "one" or "zero". These three markings, as a combination, are compared against an entry in a table defining which one of the bins containing onserts should dispense an onsert onto the magazine as it proceeds thereunder.

A unique feature of the present invention is the significant tolerance the vision system allows for misaligned mailing labels including the dot code pattern. The dot code pattern can be offset vertically or horizontally up to a ½ of an inch, as defined by a major window encompassing a reference mark window and a character window. The dot code pattern can also be skewed up to 15 degrees from a normal orientation behind the character windows. Thus, the vision system can be configured to tolerate the skewing errors of reference markings and characters on a mailing label, which is not uniformly applied to the magazine. The system is significantly more tolerant of alignment problems than bar code readers, line scanners, or optical sensors, and thus, can reliably identify the dot code pattern quickly and reliably.

The custom configuration of the software provided by the CVIM Vision System is sufficiently flexible to provide the arrangement of windows disclosed by the present invention. The arrangement of windows is uniquely adapted to the problems addressed by the present invention.

Another feature of the present invention is the flexibility to perform other post production processes to the magazines including mail sortation by sensing mail sortation marks, and to subsequently apply personalized messages upon the cover of the magazine depending on the dot code pattern of each given dot code pattern using an ink-jet printer. Off-line processing can be performed as well by processing finished magazines manufactured elsewhere, wherein the off-line processing is performed independently of the assembly of the magazine itself. Hence, the possibilities for post production processing, are numerous.

BRIEF DESCRIPTION OF THE DRAWINGS

FIG. 3A is an address label including a sequential dot code pattern which is identified by the vision system;

FIG. 3B is a table identifying which dot code patterns correspond to which combinations of selected onsert pockets;

FIG. 4 is a profile view of a standard rotary pocket dispenser including the vision system for identifying the dot code patterns on the label.

DESCRIPTION OF THE PREFERRED EMBODIMENT

Figure 1:
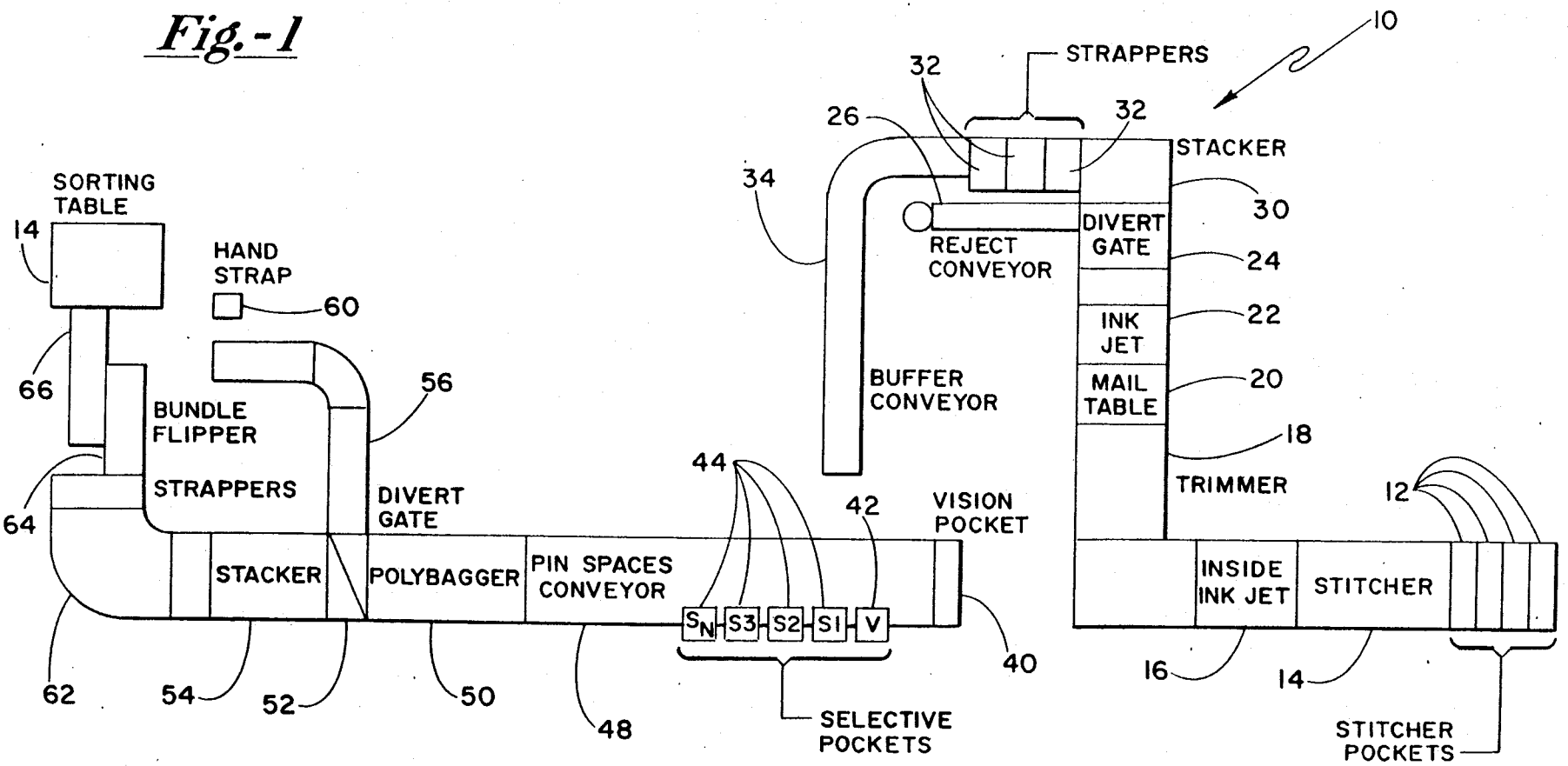
FIG. 1 is a blocked diagram of a bagging assembly implementing a video imaging system.

Referring now to FIG. 1, a blocked diagram of the preferred embodiment of a bagging assembly implementing a video imaging system according to the present invention it is generally shown at 10. Assembly 10 essentially integrates several stitcher pockets 12 into magazines, brochures or the like, and eventually transfers the magazines to a sorting table 14. Several onserts or "tip-one" such as advertising material or leaflets, can be selectively added to the magazine along the way. Thereafter, the magazine and the onserts are assembled together into a polybagger in preparation of mailing to a subscriber, or the like.

Stitcher pockets 12 contain signatures that are integrated together in a known manner, whereupon a stitcher 14 binds the signatures together to form a magazine, book, or the like. Thereafter, an ink-jet printer 16 prints messages for the consumer on an inside cover of the bound magazine. Next, a trimmer 18 consisting of sharpened edges trims the ends of the magazine such that the edges are square and uniform.

The magazine proceeds along assembly 10 to a mail table 20, wherein a labelling station, including an ink-jet printer 22, generates an address label (FIG. 3) including a dot pattern corresponding to which ones of the onserts are to be later added to the magazine, as will be described shortly. The address label is sprayed upon the cover of the magazine at this station, whereupon the magazine proceeds to a divert gate 24. Here, defective magazines are sensed and when found are diverted to a reject conveyor 26, wherein replacement magazines will be generated later. Acceptable magazines proceed onward to a stacker 30, whereupon magazines are stacked into bundles of approximately 20 magazines. However, limitation to the size of this stack is not to be inferred. Thereafter, several strappers 32 strap the stack of magazines together using plastic straps, or the like. The assembled bundle of magazines proceeds forward on a buffer conveyor 34. The speed of buffer conveyor 34 can be adjusted such that the rate at which bundles proceed onward can be selectively determined.

As the bundles of magazines reach the end of the buffer converyor 34, the bundles are manually transferred over to a vision rotary pocket 40. However, this procedure can also be done automatically using well-known robotic technology or the like. Rotary pocket 40 comprises a rotary pocket dispenser, as shown in FIG. 4, which is well known in the art and which will be discussed shortly. The rotary pocket dispenses one magazine at a time from pocket filler 40, whereupon a vision identification system including a video camera 42 senses and identifies the dot pattern defined on the address label (FIGS. 5A–5D, FIG. 6) to determine which of several bins or pockets 44 sequentially positioned thereafter should dispense an onsert or "tip-on" upon the magazine, and to sense a pair of mail sortation marks which will be discussed shortly. Vision system 42 operates independently from and in cooperation with the front end magazine assembly process, and thus operates upon magazines handed-off from the assembly stages including stitcher 14.

Next, the magazine proceeds from the vision system in timed registration under each of the selective pockets 44 identified as pockets $S_1$, through $S_n$ in a sequential fashion. As the magazines proceed underneath each of the selective pockets 44, those pockets 44 identified by the dot code pattern read by the vision identification system including will dispense one contained onsert upon the magazine. Once the magazine has received all of the onserts identified by its coded label, the magazine proceeds down a pin space conveyor 48 to a polybagger 50, which encloses and seals the magazine and the onserts into a polyethylene bag. The mailing label of the magazine is visible through the polybag.

A divert gate 52 is automatically positioned depending on the pair of mail sortation marks which are sensed by video camera 42, a shown in FIG. 6 and will be discussed shortly. Divert gate 52 either lets the magazines proceed to an automatic stacker assembly 54, similar to stacker 30, or to route the magazines to a divert conveyor 56. Conveyor 56 progresses the magazines to a hand-strap station 60, such as magazines which are printed as replacements for magazines which were damaged earlier, where the magazines are hand-strapped into a bundle. Piles of three pieces or less which are to be sent to small companies are also hand strapped per U.S. Postal Regulations. If the magazines are allowed to proceed to stacker 54, the magazines having the same zip codes are stacked and eventually strapped together by strappers 62 according to the mail sortation marks defined on the mailing label as will also be discussed shortly. Thereafter, the bundle of magazines proceeds to a bundle flipper 64, whereupon the bundle proceeds on a conveyor 66 such that the bundle proceeds eventually to sorting table 14. Thus, assembly 10 automatically assembles a magazine, selectively adds onserts to it, ultimately seals the combination in a polybag, and sorts the magazines into bundles for mailing. Further, the vision system including the video camera 42 is sophisticated and tolerates significant alignment errors of the address label, which is not necessarily uniformly affixed to each magazine as will be discussed shortly.

Figure 2:
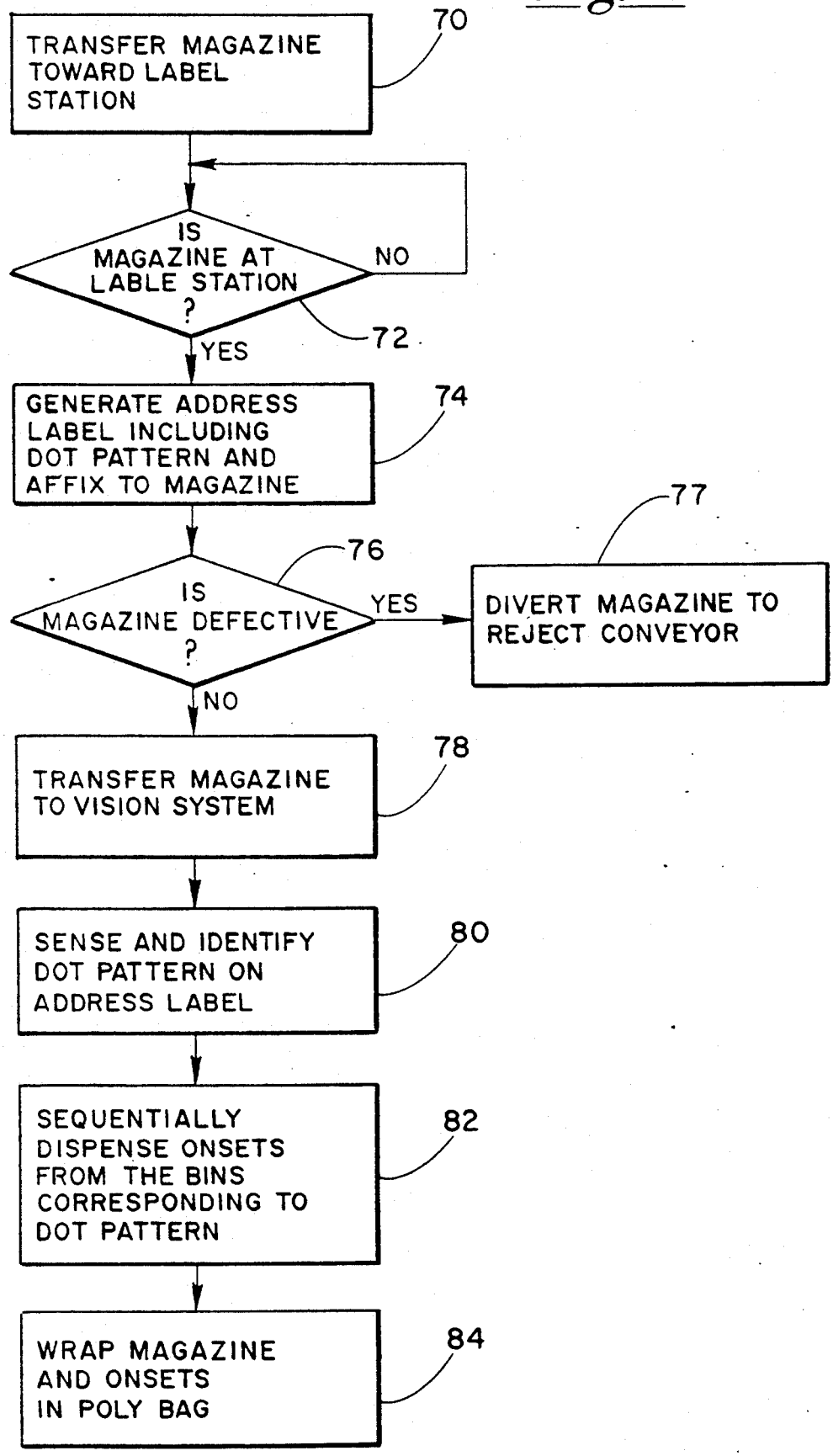
FIG. 2 is a flow diagram of a process implementing the video imaging system for determining which onserts are to be deposited onto certain magazines.

Referring to FIG. 2, a flow diagram of the process just described will be discussed. At step 70, each of the magazines are sequentially transferred toward the label station including mail table 20 and ink-jet printer 22. Once the magazine is sensed at the label station at step 72, the ink-jet printer 22 under computer control generates an address label (FIG. 3) having a dot code pattern at step 74, and the label is either affixed to the magazine using an adhesive or the like or printed on the cover itself. A sample address label is shown in FIG. 3, the various possible dot code patterns are shown in the Table of FIG. 3A and will be discussed shortly. The dot code pattern is essentially a binary representation of an address for a table stored in a memory defining which pockets are to later be enabled by the identification system to dispense an onsert upon the magazine as it passes thereunder. The dot code pattern is associated with specific characteristics of the mailing label. For instance, onserts contained in pocket $S_1$, may be added to a preselected group of zip codes, or, wherein onserts contained in pocket $S_2$ can be added to magazines addressed to a selected group of company names. Thus, marketing strategies based on demographics studies, or the like, can establish which onserts are to be sent to selected recipients.

Next, sensors at divert gate 24 sense and inspect the magazines at step 76, whereupon defective magazines are diverted to the reject conveyor 26 at step 77 and subsequently replaced later. If the magazines are not defective, step 78 is implemented wherein a magazine is progressed down buffer conveyor 34 at step 78. Next, the stack of magazines are either manually or automatically inserted into vision pocket 40.

At step 80 in FIG. 2 the vision system, including video camera 42, senses and identifies the dot code pattern on the address label of that magazine. As mentioned earlier, the vision system manufactured by the Allen-Bradley Company of Milwaukee, Wis. identified as the CVIM Vision System, has been found to be suitable for this identification task. It comprises a microprocessor-based CPU which performs binary and gray scale image processing. The vision system partitions the image from video camera 42 into a plurality of windows, as shown in FIGS. 5A–5D and FIG. 6, which will be discussed shortly. As the dot code pattern comes into the view of these windows, the CPU will first identify the reference marks of the code, Ø, in the respective windows by comparing against a software created mask. Next, the identification of the characters between the Ø reference marks is done on a pixel-by-pixel basis. The identified images in each of the windows, as a whole, are compared to a table stored in the microprocessor's memory to decode which of the selective pockets 44 are to subsequently dispense an onsert onto the magazine as it passes by on conveyor 48. Finally, the main sortation marks are identified to facilitate subsequent mail sorting. Each of these steps will be further discussed shortly in reference to FIGS. 5A–5D and FIG. 6.

The CVIM Vision System is highly tolerant of both lateral offsets and rotation alignment errors of the mailing label. Thus, in the present application, the vision system is superior in performance to standard bar code readers or optical sensors, which are not very forgiving of misaligned codes. Generally, mail tables do not have a reputation of consistently affixing mailing labels to magazines, and a slight rotation of the mailing label on the magazine is not uncommon.

At step 82, pin conveyor 48 progresses the magazine past each of the selective pockets 44, whereupon the associated onserts contained in the selective pockets 44 are dispensed upon the top surface of the magazine. Documents commonly known as "tip-ons" can also be stored in and dispensed from pockets 44 and applied onto the cover of the magazine prior to selectively adding onserts. Finally, another ink-jet printer can be located downstream of vision system 42 which can apply customized messages onto the magazine cover or the "tip-on" depending on which dot code pattern was sensed. Thus, many post-processing procedures can be performed depending on which dot code pattern is sensed by vision system 42. It is noted that off-line processing can also be performed by adding finished magazine or the like into pocket 40 from elsewhere for selectively post-processing, and limitation to processing magazines produced at the front end of apparatus 10 is not to be inferred.

After the magazine passes the last selective pocket 44, step 84 is performed wherein the magazine and the onserts and/or "tip-ons" are wrapped in a polybag by a conventional polybagger, and are sorted by divert gate 52 as will be discussed shortly.

Referring now to FIG. 3, a sample mailing label is generally shown at 90. Mailing label 90 comprises basic mailing information and subscription information as shown on lines 2 through 10. The dot code pattern is generally shown at 92, and is defied on line 1 of label 90. Dot code pattern 92 extends laterally and has a reference mark comprised of a "Ø" defined at each end. Defined between each of these "Ø" reference marks are three characters, each of which is either a darkened box, or a ".". Referring to FIG. 3A, the possible combination s of the three characters is shown corresponding to the appropriate pockets 44 which are to be enabled as the magazine passes thereunder. This table is stored in the memory of the vision system. For instance, selection "A" comprises the first character being a darkened box, and the second and third characters being a dot. Consequently, pocket 1 of selective pocket 44 will be enabled as the magazine passes.

Referring back to FIG. 3, label 90 has the character "A" printed at the right most portion of line 3. This facilitates easy makeup code identification, such that one can visually ascertain the corresponding dot pattern represented in line number 1. Further, this identification meets the U.S. Postal Office requirements for a selection identification. Other combinations of dot code patterns 92, such as B–G in the Table of FIG. 3A, can also be defined in line 1 of the label 90 by the ink-jet printer 22 shown in FIG. 1.

The small dots and the blackened box marks essentially form a binary code written backwards from left to right. Thus, the first selection "A", which would be represented as a 001 binary, is shown in the table as a 100 binary due to the fact that video camera 42 will sense this code in the 100 order as the magazine moves into the field-of-view of the camera. While a combination of three different characters are shown between each of the "Ø⇄ reference characters at each end, limitation to strictly three characters defining the combination of pockets 44 to be enabled is not to be inferred.

Referring now to FIG. 4, a rotary pocket 100 is generally shown at 100. Rotary pocket 100 basically comprises a drum 102 rotatably defined above a stack of magazines 104, and which removes the top magazine from the pocket as it rotates. Rotary drum pocket dispensers are well known in the art and discussion is only generally provided here. Drum 102 removes the top magazine, such as a magazine 106, wherein the video camera 42 senses the mailing label 90, and specifically, the dot code pattern 92 as shown in FIG. 3. Consequently, the vision system using video camera 42 ascertains which of the subsequent pockets 44 are to be activated as magazine 106 subsequently passes under each.

Figure 5A:
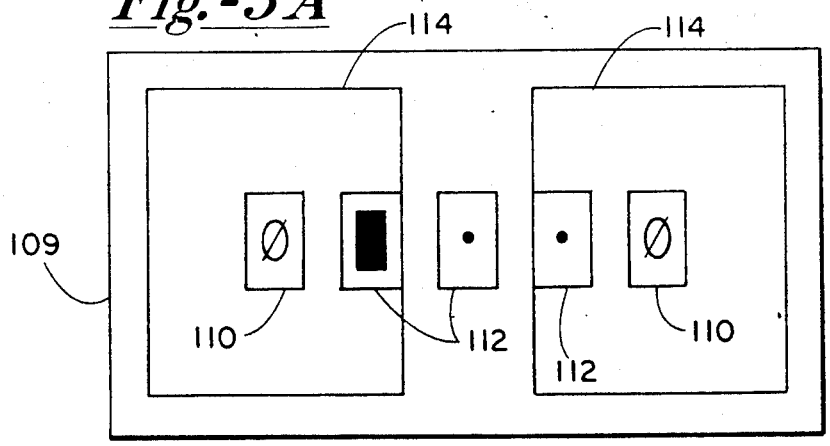
FIG. 5A is a view illustrating the arrangement of several video windows which partition an image window for identifying the dot code pattern, including reference marks and characters.

Referring now to FIGS. 5A, 5B, 5C and 6D a more detailed description of how video camera 42 ascertains and decodes the dot code pattern 92 from mailing label 90 will be discussed. As shown in FIG. 5A, the Allen-Bradley CVIM Vision System can have its vision window 109 subdivided into a plurality of windows. As shown, a pair of rectangular reference minor windows 110 are defined about each of the "Ø" reference characters of dot code pattern 92 shown in FIG. 3. Linearly arranged between each of the reference minor windows 110 are three character windows 112 of similar size. A pair of larger or major rectangular windows 114 are defined about opposite ends of the dot code pattern 92, wherein each minor window 110 is centered within the encompassed by respective major window 114. Each of minor windows 110 and 112 may typically be approximately ½ inch in height and ½ inch wide. Similarly, each major window 114 may be approximately 1.0 inch high and 1.0 inch wide.

The software of the CVIM system allows one to custom define the shapes and locations of the windows as shown in FIGS. 5A, 5B, 5C, 5D and FIG. 6. The software can process the images defined in each of the windows individually and in combination. The CVIM system compares a predefined mask stored in memory against the "Ø" referenced marks sensed in each windows 110. The CVIM system determines if the match between each sensed "Ø" reference mark and the mask exceeds a preset threshold level. If so, the video camera 42 has a valid dot code pattern 92 in its view. Thereafter, the processor continues to ascertain the identify of the character marks which are now viewable in each of character windows 112 between each window 110.

The CVIM system has a binary and gray scale image processing feature such that the processor can decide whether the marking sensed in each reference windows 112 is a relatively large darkened box or a much smaller dot. Again, using a preset threshold level, the computer will determine on a pixel-by-pixel basis whether or not enough of the pixels in the window 112 are darkened. Here entry "A" of FIG. 3A will be used as an example. If enough pixels are sensed as darkened, thus exceeding the threshold, the vision system computer will determine that the character is a black square, or a binary "1" in the first code position. If enough pixels remain white, as shown by the two right most characters in window 112, the threshold level will not be exceeded and the computer will determine those two characters in window 112 to be a binary "0". Thus, as a whole, the computer will determine that the characters in windows 112 correspond to a binary "100". The unique binary feature of the CVIM system, along with the selectable threshold level and the custom defined window sizes, allows one to define the resolution that the vision system can distinguish between a binary "1" and "Ø", thus reducing the chance of errors and false readings.

Figure 5B:
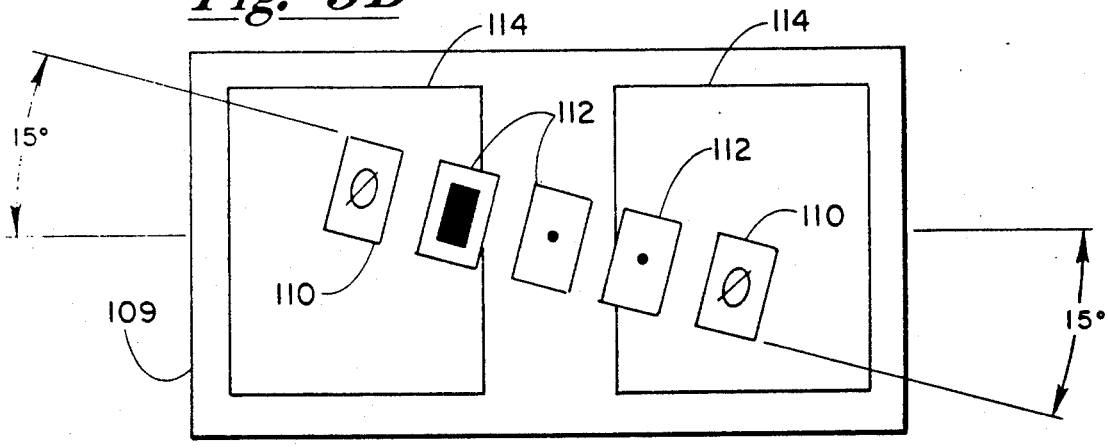
FIG. 5B is a view illustrating the dot code pattern on an address label skewed 15 degrees with respect to the video windows.

Another key feature of the CVIM system as applied to the present invention is shown in FIG. 5B. The sizes and positionability of windows 110 and 112 allow the dot code pattern 92 to be skewed up to a 15 degree angle with reference to the normal. The vision system implements an algorithm wherein each minor reference window 110 is shifted throughout the respective major window 114 until a reference character "Ø" is identified in each. Once each reference character "Ø" is found, the three character windows 112 are linearly positioned therebetween using simple interpolation such that characters can be identified using windows 112. The vertical edges of each of windows 110 and 112 are always parallel to one another, and each window 110 and 112 are always linearly arranged, as shown. Thus, even if dot code pattern 92 is skewed as much as 15 degrees, within window 109, each of the reference marks will remain viewably in windows 110 such that the CVIM system can still ascertain and decode the reference marks. Hence, the system of the present invention is much more forgiving than one using a standard optical reader or bar code reader. Typically, in printing-mailing systems as shown in FIG. 1, the mailing labels 90 are not precisely applied to each of the magazines, and as such, tend to be rotated or skewed, but seldom more than the 15 degrees which can be accommodated.

Figure 5C:
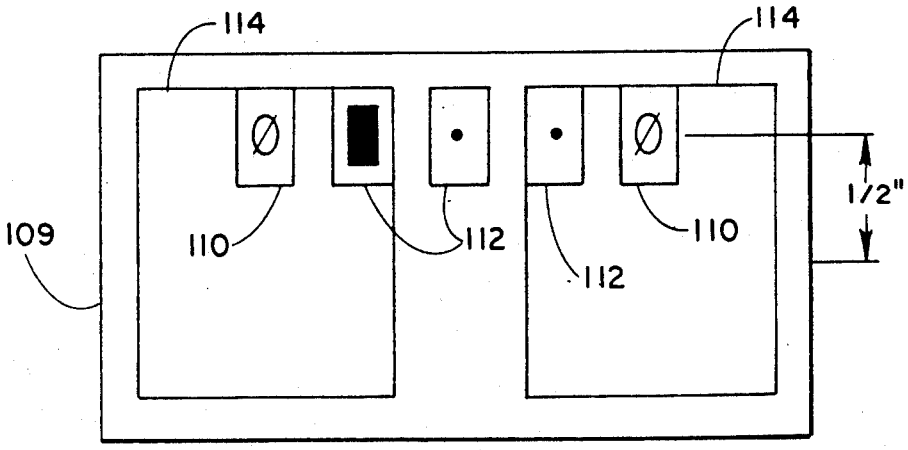
FIG. 5C is a view illustrating the dot code pattern on an address label offset vertically ½ inch from a normal orientation.
Figure 5D:
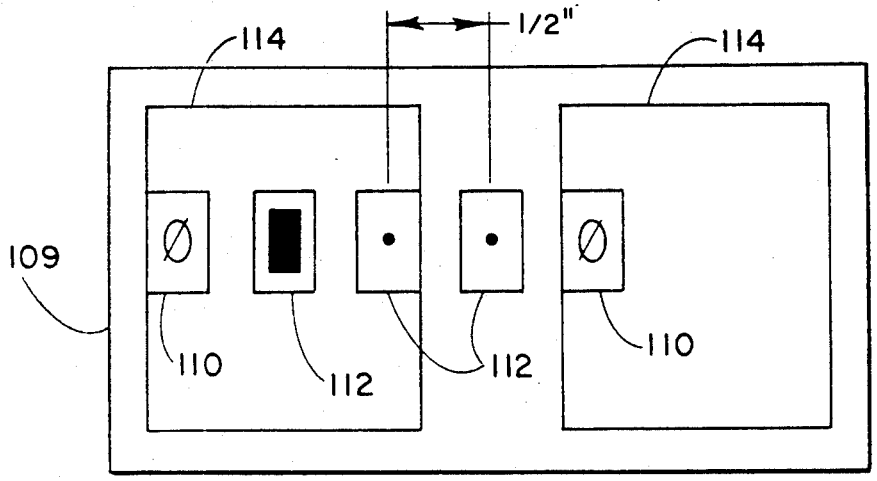
FIG. 5D is a view illustrating the dot code pattern on an address label offset horizontally ½ inch from a normal orientation.

Another key feature of the CVIM System as applied to the present invention is shown in FIGS. 5C and 5D, wherein labels 90 can be offset vertically or horizontally, respectively, up to ½ inches. This offset is difficult for a bar code or an optical based sensor to compensate for. The present invention, however, implements the pair of major reference windows 114 to define boundaries wherein each of respective reference windows 110 can be shifted and sensed vertically and horizontally, up to ½ of an inch in either direction, within reference window 114. Again, the software algorithm will shift each window 110 throughout each respective major window 114 until the reference character "Ø" is identified in each, wherein the three character windows 112 are subsequently linearly positioned therebetween to identify the corresponding three characters. Thus, as shown in FIGS. 5C and 5D, the entire dot code pattern 90 can shift upward or sideways as much as ½ inch within window 109 and the vision system can still decode the dot code pattern 92 within referenced windows 110 and 112.

The size of major window 114 is chosen to accommodate a reasonable offset. A larger window could be used to accommodate a larger offset, however, this would necessarily slow down the algorithm's processing speed which shifts the minor reference window 110 through window 114. For instance, a window 114 twice as large would require twice as much processing time for shifting window 110 therewithin to eventually identify the reference mark "Ø", thus slowing down the system's through put capability.

Figure 6:
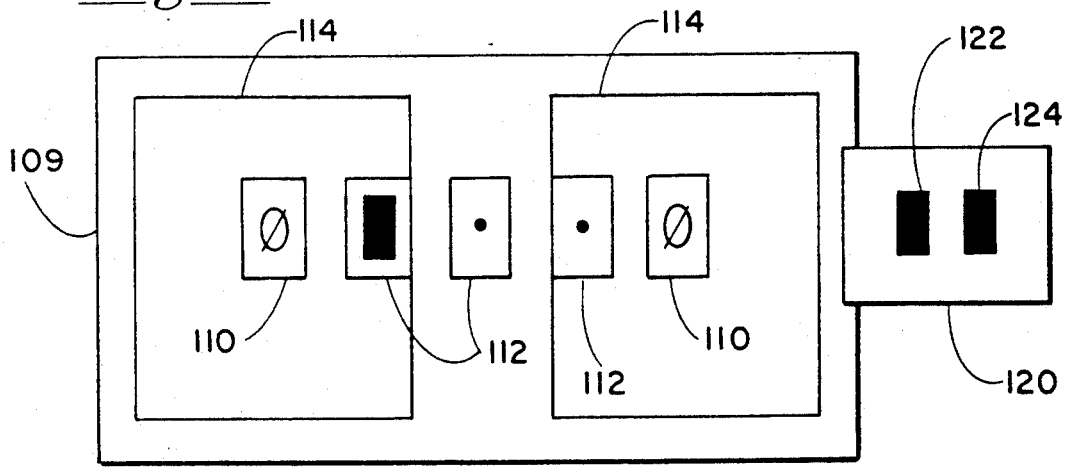
FIG. 6 is a view illustrating an additional window for sensing mail sortation marks.

Now referring to FIG. 6, a mail sortation window 120 is shown which is defined immediately to the right of minor windows 110 and 112 in a linear relationship. A first and second sortation mark 122 and 124, respectively, are selectively defined to the right of reference marks and characters in a linear relationship as well. Vision system 42 senses there marks when sensing the other characters in windows 112 to determine one of three things. If no marks are sensed, the vision system 42 determines this magazine should proceed past divert gate 42 to be added to a stack and bundled automatically later. If only one mark is sensed in window 120, then the vision system 42 determines that this label is applied to a magazine that was produced as a substitute for a damaged magazine as determined at divert gate 24. Hence, this magazine after bagging will be diverted from the stream of magazines by divert gate 52 and subsequently manually hand-strapped. If two marks are sensed, in window 120 then the vision system determines that this magazine is to be the top of a stack and strappers 62 will automatically wrap the bundle after this magazine is added to the top thereof. For instance, every twentieth magazine may have two marks to indicate that the bundle should be strapped. If this is the last magazine generated having a mailing label with a common zip code, the bundle will be wrapped regardless of how many magazines are in the stack. Thus, a new stack will be started for a new stream of magazines having a common zip code.

It should be noted that mail table 20 first generates all mailing labels having common zip codes to facilitate sorting by zip code before generating labels having a next different zip code. Thus, when the stream of magazines are eventually bundled by strapper 62, mail sortation is easily facilitated.

Window 120 is always referenced to the right most minor window 110 such that when window 110 is shifted up or down as shown in FIG. 5C and 5D, window 120 is also shifted a corresponding distance therewith since the sortation marks 122 and 124 will always be defined in a linear relationship and a predetermined distance from the right most reference mark "Ø" of dot code pattern 90.

Similarly, if minor windows 110 and 112 are rotated as shown in FIG. 5B, window 120 will be rotated the same angle as well. Window 120, windows 110, and windows 112 as a whole form a template which is always oriented after the position of the two reference windows 110 are positioned within major windows 114 when the "Ø⇄ reference marks are ascertained.

Thus, the CVIM system is adapted to tolerate the offset and rotational skewing of reference code markings 92 on mailing labels 90 applied to magazines. Since the reference windows can be custom defined in location and size, the ideal window sizes can be programmed on both trial and error basis, and on empirical settings. Limitation to the placement and sizes of the reference windows as shown here is not to be inferred.

Whereas optical readers often have the task of decoding alphanumatic symbols, this vision system decodes characters corresponding to a binary "1" or "Ø", which is much simpler to process. Therefore, this vision system is highly reliable and flexible in ascertaining and decoding the corresponding dot code pattern of every mailing label of a magazine before subsequently being routed past pockets, which are responsive to the sensed dot code pattern.

The present invention is a great improvement over the prior art systems implementing optical coders and bar code readers since it is custom designed to the described dot code pattern, and it is forgiving of moderate alignment errors. Further, this is a high speed system capable of decoding up to 180 dot code patterns per minute.

As shown in the various embodiments, many post-processing procedures can be performed by sensing and identifying the dot code pattern. Selectively adding onserts and "tip-ons", identifying if automatic or manual strapping is to be performed for mailing, and identifying the top of stack magazine for mail sortation are just the preferred applications for implementing a vision system with a magazine assembly apparatus, and limitation to just these applications is not to be inferred. Post-processing is an important feature realized because the vision system operates independently of the magazine assembly stages.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and the various modifications, both as to the equipment details and operating procedures, can be accomplished without departing from the scope of the invention itself.

I claim:

1. A method of selectively adding onserts contained in a plurality of storage bins to a continuous stream of printed magazines, comprising:

(a) sequentially generating address label information including a dot code pattern and applying the address able to each of the magazines in said stream, wherein the dot code pattern define which of the onserts in said plurality of storage bins are to be added to each magazine;

(b) transferring said magazines sequentially to an identification station;

(c) sensing at the identification station the dot code pattern of the label on said magazines using a computering means including a video camera, said computing means generating a plurality of video windows for decoding the dot code pattern to determine which ones of the onserts are to be added to each magazine;

(d) sequentially transferring said magazines past each of the plurality of storage bins, wherein the bins corresponding to the dot code pattern on a given magazine are sequentially actuated to dispense an onsert onto said given magazine as it passes by; and (e) inserting said magazines with its added onserts into a polybag at a polybag station for ultimate mailing.

2. The method of claim 1 wherein the dot code pattern comprises a set of reference marks and a set of characters, said video windows first identifying the set of reference marks, and then identifying the set of characters.

3. The method of claim 2 wherein at least one of said reference marks appears at the head end and tail end of said set of characters.

4. The method of claim 3 wherein said reference marks and said characters are arranged in a substantially linear relationship on said label.

5. The method of claim 2 wherein said set of characters comprise of marks corresponding to either a binary "1" or a binary "Ø".

6. The method of claim 2 wherein said plurality of windows are comprised of at least one first minor window for sensing one of said reference marks, and at least one second minor window for sensing one of said characters.

7. The method of claim 6 wherein said plurality of windows further comprises a first major window encompassing one of said first minor windows for defining an offset parameter of the dot code pattern, wherein said first minor window is selectively positionable therewithin.

8. The method of claim 7 wherein said plurality of windows further comprises a second major window encompassing a separate one of said first minor windows which is selective positionable therewithin, wherein said first and second major windows, in combination, define a rotational skewing parameter of the dot code pattern.

9. The method of claim 1 wherein said dot code pattern is generated by an ink jet printer.

10. A method of determining which of a set of post-production processes are to be performed for a continuous stream of printed magazines, comprising:

(a) sequentially generating address label information including a dot code pattern and applying the address able to each of the magazines in said stream, wherein the dot code pattern defines which of the post-production processes will be applied to each magazine;

(b) transferring said magazines sequentially to an identification station;

(c) sensing and identifying at the identification station the dot code pattern of the label on said magazines using a computing means including a video camera, said computing means generating a plurality of video windows for decoding the dot code pattern to determine which ones of the post-production processes are to be performed to each magazine; and (d) performing said identified post-production process to each said magazine.

11. The method of claim 10 wherein said dot code pattern corresponds to which ones of a set of onserts or tip-on are to be added to each magazine, wherein said step (d) comprises sequentially transferring said magazines past each of a plurality of storage bins, wherein the bins corresponding to the dot code pattern on a given magazine are sequentially actuated to dispense an onsert or a tip-on onto said given magazine.

12. The method of claim 10 wherein said dot code pattern corresponds to which of a set of personalized messages are to be defined upon each magazine, wherein said step (d) comprises transferring said magazines past a printer for applying said messages to said magazine.

13. The method of claim 10 wherein said dot code pattern includes mail sortation marks, wherein said step (d) performs mail sortation procedures upon each said magazine depending upon said mail sortation marks.

14. The method of claim 10 wherein said mail sortation marks are indicative of if said magazine is to be on top of a bundled stack of said magazines.

15. The method of claim 13 wherein said mail sortation marks are indicative of it said magazine is to be manually bundled.

* * * * *

UNITED STATES PATENT AND TRADEMARK OFFICE

CERTIFICATE OF CORRECTION

PATENT NO. : 5,189,863
DATED : March 2, 1993
INVENTOR(S) : John R. Pozzi

It is certified that error appears in the above-indentified patent and that said Letters Patent is hereby corrected as shown below:

Column 11, claim 1, line 6, letter (a), after the word "address", "able" should be changed to --label--.

Column 12, claim 1, line 13, letter (c), "computering" should be changed to --computing--.

Column 12, claim 10, line 6, letter (a), after the word "address", "able" should be changed to --label--.

Column 13, claim 11, line 3, after the words "onserts or", "tip-on" should be changed to --tip-ons--.

Signed and Sealed this

Eleventh Day of June, 1996

*Attest:*

Bruce Lehman

BRUCE LEHMAN

*Attesting Officer*

*Commissioner of Patents and Trademarks*